US007464695B2

(12) United States Patent
Bauerle et al.

(10) Patent No.: US 7,464,695 B2
(45) Date of Patent: Dec. 16, 2008

(54) THROTTLE BODY RESTRICTION INDICATOR

(75) Inventors: Paul A. Bauerle, Fenton, MI (US); Morgan Chemello, Brighton, MI (US); Joseph M. Stempnik, Warren, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/829,246

(22) Filed: Jul. 27, 2007

(65) Prior Publication Data

US 2008/0223335 A1 Sep. 18, 2008

Related U.S. Application Data

(60) Provisional application No. 60/918,612, filed on Mar. 16, 2007.

(51) Int. Cl.
*F02D 41/18* (2006.01)

(52) U.S. Cl. ..... 123/396

(58) Field of Classification Search ..... 123/396, 123/397, 399; 73/118.2
See application file for complete search history.

(56) References Cited

U.S. PATENT DOCUMENTS

| | | | | |
|---|---|---|---|---|
| 6,698,398 | B2 * | 3/2004 | Bauerle | 123/399 |
| 6,711,492 | B1 * | 3/2004 | Pursifull et al. | 701/114 |
| 6,925,864 | B2 * | 8/2005 | Beyer et al. | 73/118.1 |
| 6,957,140 | B1 * | 10/2005 | Bauerle et al. | 701/110 |
| 7,287,510 | B2 * | 10/2007 | Costin et al. | 123/336 |

* cited by examiner

*Primary Examiner*—Hai H Huynh

(57) ABSTRACT

A control system for a vehicle comprises a throttle control module and a diagnostic module. The throttle control module controls a position of a throttle of the vehicle and compensates for changes in effective opening area of the throttle due to coking. The diagnostic module reports a coking value to a user based upon an amount of compensation performed by the throttle control module. A method comprises controlling a position of a throttle of a vehicle; compensating for changes in effective opening area of the throttle due to coking; and reporting a coking value to a user based upon an amount of compensation performed.

28 Claims, 5 Drawing Sheets

THROTTLE BODY RESTRICTION INDICATOR

This application claims the benefit of U.S. Provisional Application No. 60/918,612, filed on Mar. 16, 2007. The disclosure of the above application is incorporated herein by reference.

FIELD

The present disclosure relates to throttle area control in motor vehicles.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Referring now to FIG. 1, a functional block diagram of a vehicle powertrain 100 according to the prior art is presented. The vehicle powertrain 100 includes an engine 102 that generates drive torque. Air is drawn into an intake manifold 104 of the engine 102 through a throttle 106. Operation of the engine 102 is monitored and controlled by a control module 110.

The control module 110 receives signals from a MAP (Manifold Absolute Pressure) sensor 112 in the intake manifold 104, a throttle position sensor 114, a MAF (Mass Air Flow) sensor 116, and other sensors (not shown). The control module 110 controls various functions of the engine 102, including opening and closing the throttle 106. The control module 110 receives driver input from, for example, an accelerator pedal position sensor 120.

The control module 110 also receives input from vehicle control systems, such as a cruise control module 122, a stability control system (not shown), a traction control module (not shown), etc. The control module 110 determines the desired engine torque based upon the inputs. The control module 110 instructs the throttle 106 to open to a specified position to allow a desired airflow into the engine 102 to produce that desired engine torque.

The control module 110 may use a mapping from desired airflow to throttle area opening to determine the desired throttle area opening. The control module 110 may then use a mapping from throttle area opening to throttle position to determine where to position the throttle 106. The relationship between desired throttle area opening and throttle position may change over time. For example, deposits may accumulate on the throttle 106, especially in applications where vehicle drive times are short.

The accumulation of deposits on the throttle 106 is sometimes referred to as coking. To compensate for such changes, a Learned Airflow Variation Algorithm (LAVA) has been disclosed in commonly assigned U.S. Pat. Nos. 7,024,305 and 6,957,140, the disclosures of which are hereby incorporated by reference in their entirety. In various implementations, the LAVA provides for two tables that each include a mapping from uncompensated throttle area to throttle area correction factor.

The throttle area correction factor may be added to the uncompensated throttle area to produce a compensated throttle area. The compensated throttle area can then be mapped to a throttle blade position for the throttle 106. The throttle area correction factor may be negative when an empirically determined throttle area opening is larger than expected for a given throttle position. The two tables may be an upper table and a lower table, corresponding to larger uncompensated area values and smaller uncompensated area values, respectively.

The upper and lower tables may include mutually exclusive ranges of uncompensated throttle area or may overlap at one or more uncompensated throttle area values. The upper and lower tables may each have a predetermined upper limit for the amount of throttle area correction. The control module 110 may update the upper and lower tables to reflect changes in effective throttle area opening based upon airflow data from the MAP sensor 112 and the MAF sensor 116.

SUMMARY

A control system for a vehicle comprises a throttle control module and a diagnostic module. The throttle control module controls a position of a throttle of the vehicle and compensates for changes in effective opening area of the throttle due to coking. The diagnostic module reports a coking value to a user based upon an amount of compensation performed by the throttle control module.

In other features, the coking value is based upon the amount of compensation performed with respect to an amount of compensation allowed. The coking value is based upon dividing the amount of compensation performed by the amount of compensation allowed. The throttle control module maintains a first table of throttle area compensation factors. The first table is indexed by uncompensated throttle area.

In further features, the throttle control module applies a first upper limit to the throttle area compensation factors and the diagnostic module reports a relation between the throttle area compensation factors and the first upper limit. The diagnostic module reports a percentage calculated by dividing a maximum one of the throttle area compensation factors by the first upper limit.

In still other features, the throttle control module maintains a second table of throttle area compensation factors, applies a second upper limit to the throttle area compensation factors of the second table, determines a first relation between the throttle area compensation factors of the first table and the first upper limit, determines a second relation between the throttle area compensation factors of the second table and the second upper limit, and reports a maximum one of the first and second relations. The diagnostic module selectively instructs the throttle control module to clear the first and/or second tables based upon user input.

In other features, the control system further comprises a visual display module. The diagnostic module reports the coking value to the visual display module when the coking value exceeds a threshold. The diagnostic module reports the coking value to a scan tool operated by the user. The control system further comprises a remote diagnostic module. The remote diagnostic module transmits the coking value to a service provider. The service provider includes a satellite service provider.

A method comprises controlling a position of a throttle of a vehicle; compensating for changes in effective opening area of the throttle due to coking; and reporting a coking value to a user based upon an amount of compensation performed.

In other features, the method further comprises determining the coking value based upon the amount of compensation performed with respect to an amount of compensation allowed. The method further comprises determining the coking value by dividing the amount of compensation performed by the amount of compensation allowed. The method further comprises maintaining a first table of throttle area compensation factors.

In further features, the first table is indexed by uncompensated throttle area. The method further comprises applying a first upper limit to the throttle area compensation factors; and reporting a relation between the throttle area compensation factors and the first upper limit. The method further comprises reporting a percentage calculated by dividing a maximum one of the throttle area compensation factors by the first upper limit.

In still other features, the method further comprises maintaining a second table of throttle area compensation factors; applying a second upper limit to the throttle area compensation factors of the second table; determining a first relation between the throttle area compensation factors of the first table and the first upper limit; determining a second relation between the throttle area compensation factors of the second table and the second upper limit; and reporting a maximum one of the first and second relations.

In other features, the method further comprises selectively clearing the first and/or second tables based upon user input. The method further comprises visually reporting the coking value to the user when the coking value exceeds a threshold. The method further comprises reporting the coking value to a scan tool operated by the user. The method further comprises transmitting the coking value to a service provider. The method further comprises transmitting the coking value to a service provider via satellite.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
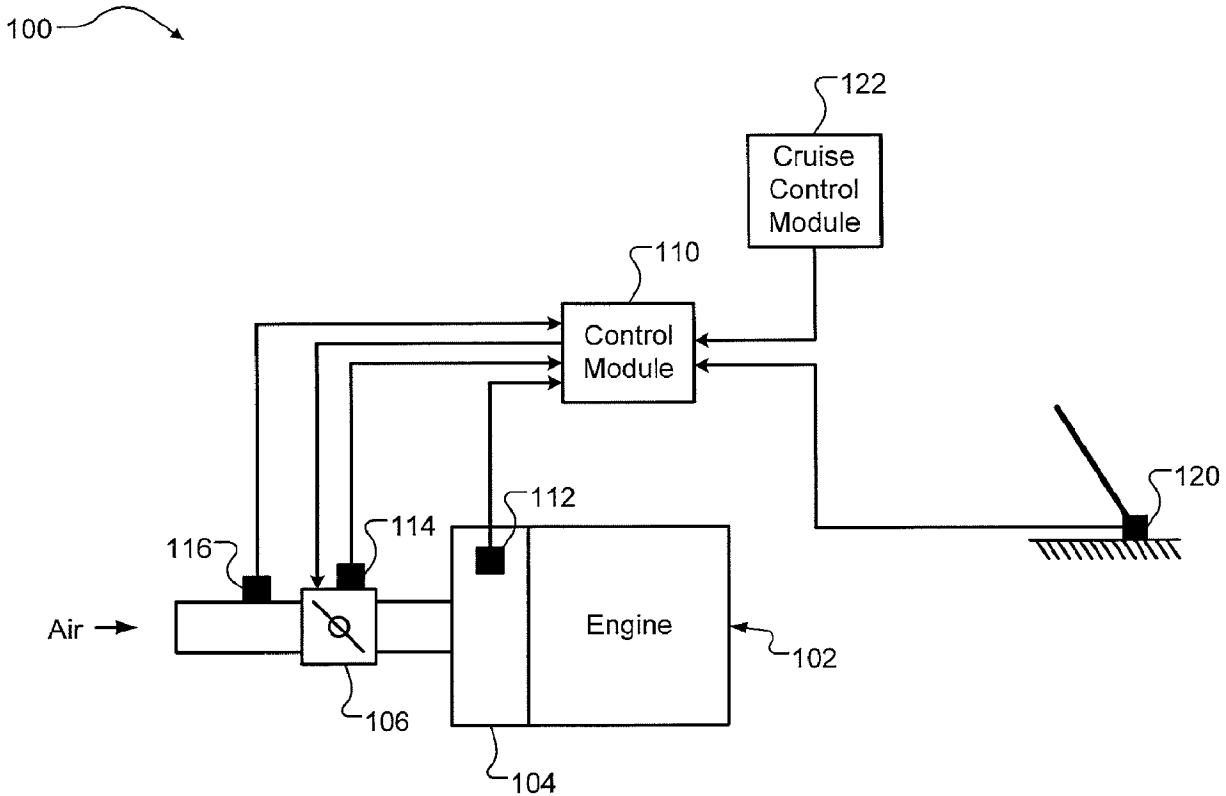
FIG. 1 Prior Art
FIG. 1 is a functional block diagram of a vehicle powertrain according to the prior art.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Figure 2:
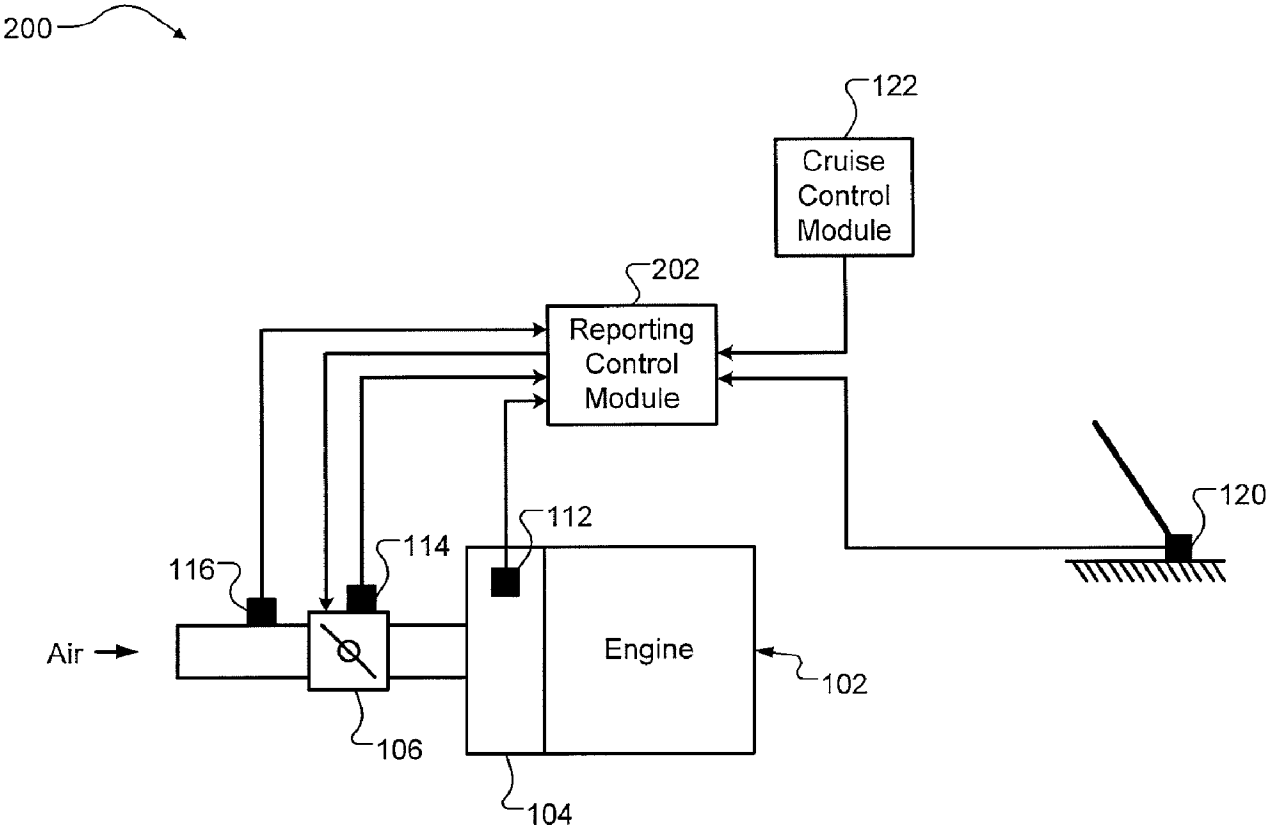
FIG. 2 is a functional block diagram of an exemplary vehicle powertrain system according to the principles of the present disclosure.

Referring now to FIG. 2, a functional block diagram of an exemplary vehicle powertrain system 200 according to the principles of the present disclosure is presented. The powertrain system 200 includes the engine 102 and a reporting control module 202. The reporting control module 202 determines the amount of correction applied to uncompensated throttle area values to correct for changes in effective opening area of the throttle 106, such as by accumulation of deposits (i.e., coking).

When the correction being applied becomes too large, the reporting control module 202 can report this highly coked condition. For example, the reporting control module 202 may display a warning message on a vehicle information system or may transmit the message, such as by satellite, to a service provider, which can then contact the driver.

In addition, the reporting control module 202 may be configured to report the amount of throttle area correction to scan tools, such as are employed by vehicle service technicians. The throttle 106 can then be cleaned preemptively before accumulation of deposits affects the performance of the vehicle. The amount of throttle area correction may be measured as a percentage. The percentage may be determined by dividing the maximum throttle area correction applied by the maximum throttle area correction allowed. The reporting control module 202 may signal the highly coked condition when the percentage is greater than a predetermined value.

Figure 3:
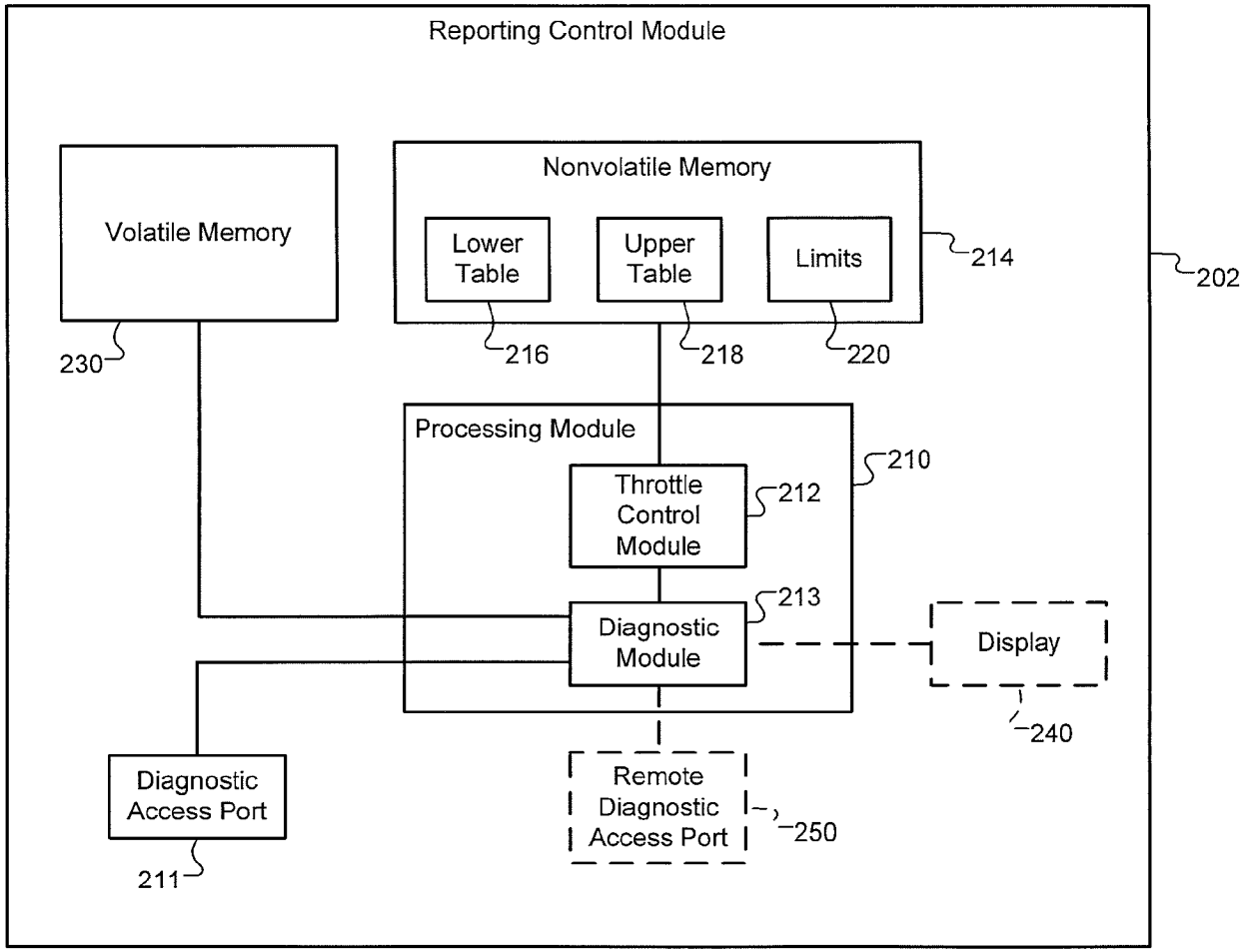
FIG. 3 is an exemplary functional block diagram of the reporting control module according to the principles of the present disclosure.

Referring now to FIG. 3, an exemplary functional block diagram of the reporting control module 202 according to the principles of the present disclosure is presented. The reporting control module 202 includes a processing module 210, a diagnostic access port 211, and nonvolatile memory 214. The processing module 210 may include a throttle control module 212 and a diagnostic module 213. The throttle control module 212 may update a lower table 216 and an upper table 218 within nonvolatile memory 214. The lower and upper tables 216 and 218 may include throttle area correction factors indexed by uncompensated throttle opening area.

Nonvolatile memory 214 may also include limits 220 that determine the maximum amount of correction that can be applied by the lower table 216 and the upper table 218. The limits 220 may be different for the lower and upper tables 216 and 218 and may be established by a calibrator. The diagnostic module 213 may receive data requests from the diagnostic access port 211. The diagnostic module 213 may respond to these requests with a percentage.

The percentage may indicate how much of the allowed correction is currently being applied to throttle opening area values. The percentage may be the larger of percentages calculated for the lower table 216 and the upper table 218. The diagnostic module 213 may periodically calculate percentages for the lower and upper tables 216 and 218 and store these percentages in volatile memory 230 and/or nonvolatile memory 214. The percentages for the lower and upper tables 216 and 218 may be calculated by taking the maximum value from the table and dividing it by the limit for the table.

To respond to data requests from the diagnostic access port 211, the diagnostic module 213 may transmit the larger of the percentages for the lower and upper tables 216 and 218 to the diagnostic access port 211. The diagnostic access port 211 may also receive an instruction commanding the throttle control module 212 to clear the lower and/or upper tables 216 and 218. Such an instruction may be issued after the throttle 106 has been cleaned.

When the vehicle is in for service, the service technician can connect to the diagnostic access port 211 to determine the state of the throttle 106. The service technician may then be able to recommend preventative maintenance to the vehicle owner. In addition, throttle restriction information may be used in troubleshooting drivability concerns reported by the owner.

The diagnostic module 213 may output the selected percentage to an optional display 240. The diagnostic module 213 may wait to transmit the selected percentage to the display 240 until the percentage has crossed a threshold, such as 80%. The diagnostic module 213 may also transmit the percentage to a remote diagnostic access port 250.

The remote diagnostic access port 250 may include satellite communication capability to relay service information, such as correction percentages, to a remote service provider. The remote service provider can then contact the owner of the vehicle to indicate that the throttle 106 may need to be serviced. In various implementations, the diagnostic module 213 may wait until the selected percentage has crossed a threshold before transmitting the percentage to the remote diagnostic access port 250. For purposes of example only, the threshold may be 70%.

Additionally, the remote diagnostic access port 250 may be configured to receive remote data requests, which the diagnostic module 213 can service in the same way as data requests from the diagnostic access port 211. In this way, the remote service provider may be able to periodically query the vehicle to determine the state of the throttle 106. In addition, the remote service provider may be able to issue a clear instruction to clear the lower and/or upper tables 216 and 218 when troubleshooting vehicle operation.

Figure 4:
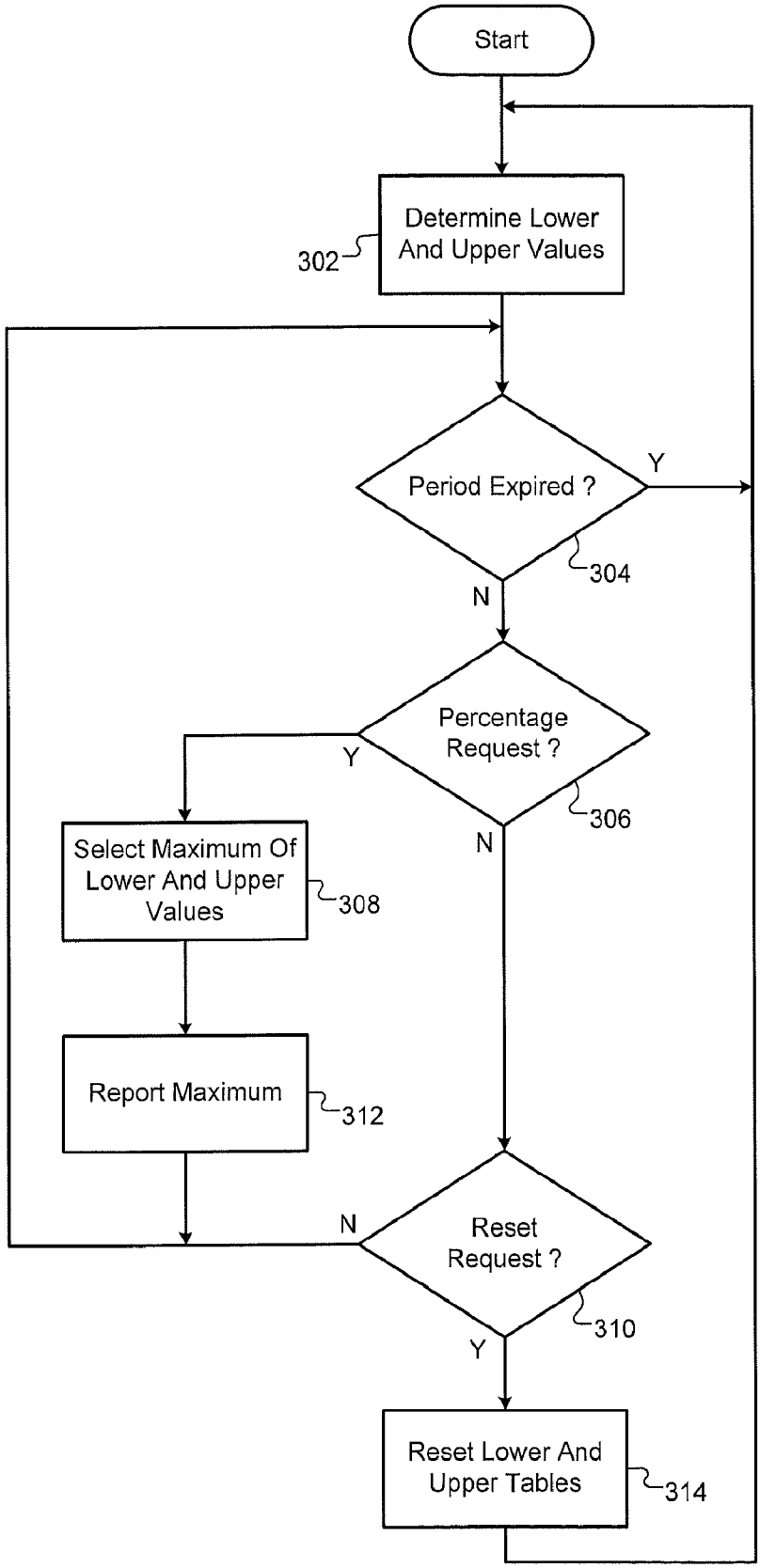
FIG. 4 is flowchart depicts exemplary steps performed by the reporting control module according to the principles of the present disclosure.

Referring now to FIG. 4, a flowchart depicts exemplary steps performed by the reporting control module 202 according to the principles of the present disclosure. Control begins in step 302, where lower and upper values are determined, corresponding to the lower and upper tables 216 and 218, respectively. This process is discussed in more detail to FIG. 5. Control continues in step 304, where control determines if a predetermined time period has expired. This period determines how often the lower and upper values are calculated. This period may correspond to a preexisting vehicle control loop, which may be a 250 millisecond loop.

If the period has expired, control returns to step 302 to calculate new lower and upper values; otherwise, control transfers to step 306. In step 306, control determines whether a data request has been made for the correction percentage. If so, control transfers to step 308; otherwise, control transfers to step 310. In step 308, control determines the correction percentage, such as by selecting the maximum of the lower and upper values. Alternatively, the lower and upper values may also be determined when a data request has been made. In various other implementations, the maximum of the lower and upper values may be selected once the lower and upper values are determined. Control continues in step 312, where the maximum is reported as the correction percentage. Control then returns to step 304.

In step 310, control determines whether a reset request has been received. If so, control transfers to step 314; otherwise, control returns to step 304. In step 314, the lower and upper tables 216 and 218 are reset and control returns to step 302. The lower and upper tables 216 and 218 may be reset to all zeroes or to predetermined values, which may be set by a calibrator.

Figure 5:
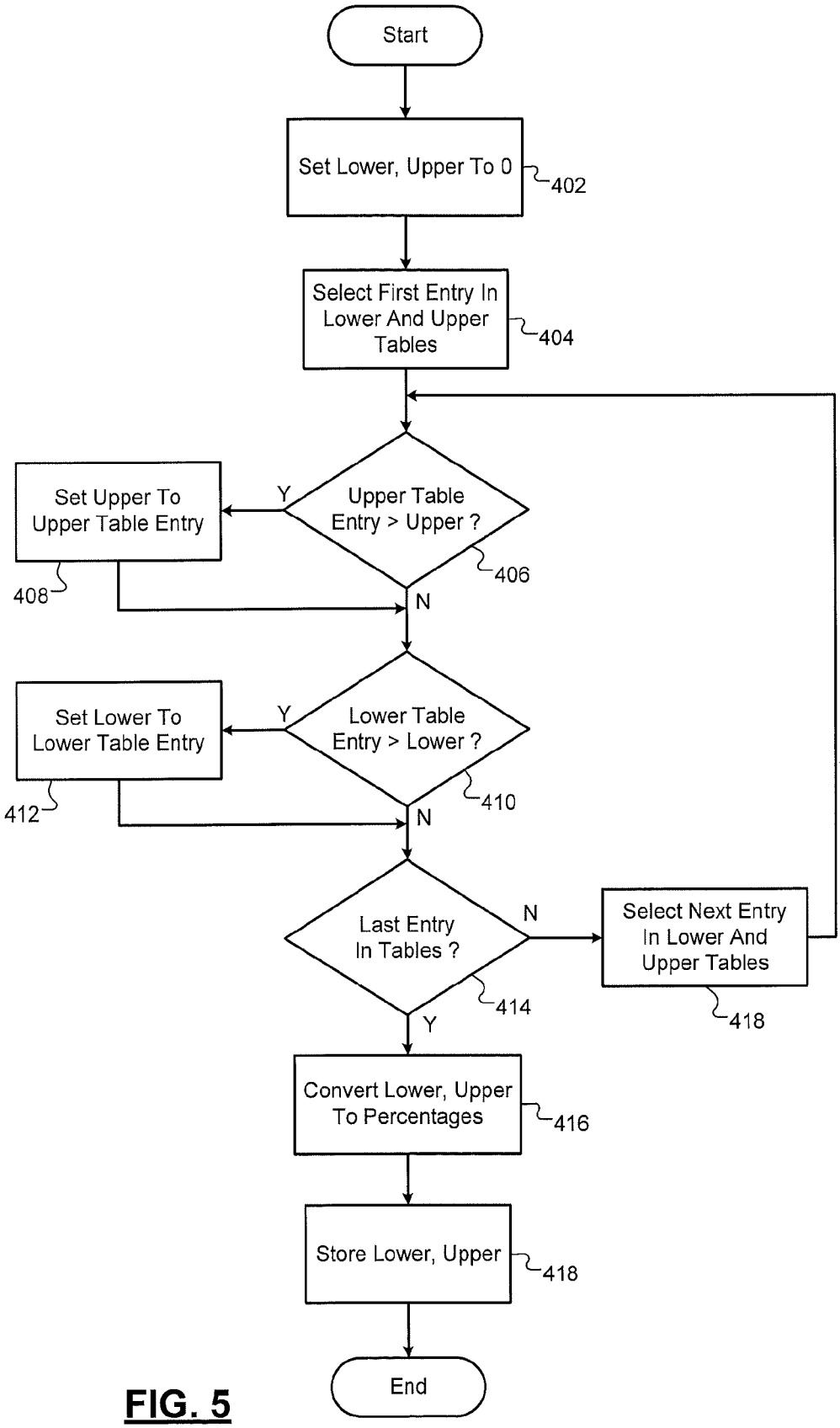
FIG. 5 is a flowchart depicts exemplary steps performed in determining maximum upper and lower values according to the principles of the present disclosure.

Referring now to FIG. 5, a flowchart depicts exemplary steps performed by step 302 of FIG. 4 in determining maximum upper and lower values according to the principles of the present disclosure. Control begins in step 402, where two variables, lower and upper, are set to zero. Control continues in step 404, where the first entry in the lower and upper tables 216 and 218 is selected.

Control continues in step 406. If the selected entry in the upper table 218 is greater than the variable upper, control transfers to step 408; otherwise, control transfers to step 410. In step 408, the variable upper is set to the value of the selected entry in the upper table 218 and control continues in step 410. In step 410, if the selected entry in the lower table 216 is greater than the variable lower, control transfers to step 412; otherwise, control transfers to step 414.

In step 412, the variable lower is set to the value of the selected entry in the lower table 216, and control continues in step 414. In step 414, if a selected entry is the last entry in the lower or upper tables 216 and 218, control transfers to step 416; otherwise, control transfers to step 418. FIG. 5 could be easily modified to allow for upper and lower tables of different sizes, or for a single combined table.

In step 416, the next entry in the lower and upper tables 216 and 218 is selected and control returns to step 406. In this way, each entry in the lower and upper tables 216 and 218 is evaluated and the largest entry is stored in the lower and upper variables, respectively. In step 416, the lower and upper variables are converted to percentages.

For example, the lower variable may be divided by the maximum correction value for the lower table 216 as indicated by the limits 220. The upper value may be divided by the maximum correction value for the upper table 218 as indicated by the limits 220. Control continues in step 418, where the lower and upper variables are stored. Control then ends.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A control system for a vehicle, comprising:

a throttle control module that controls a position of a throttle of said vehicle and that compensates for changes in effective opening area of said throttle due to coking; and a diagnostic module that reports a coking value to a user based upon an amount of compensation performed by said throttle control module.

2. The control system of claim 1 wherein said coking value is based upon said amount of compensation performed with respect to an amount of compensation allowed.

3. The control system of claim 2 wherein said coking value is based upon dividing said amount of compensation performed by said amount of compensation allowed.

4. The control system of claim 1 wherein said throttle control module maintains a first table of throttle area compensation factors.

5. The control system of claim 4 wherein said first table is indexed by uncompensated throttle area.

6. The control system of claim 4 wherein said throttle control module applies a first upper limit to said throttle area compensation factors and said diagnostic module reports a relation between said throttle area compensation factors and said first upper limit.

7. The control system of claim 6 wherein said diagnostic module reports a percentage calculated by dividing a maximum one of said throttle area compensation factors by said first upper limit.

8. The control system of claim 6 wherein said throttle control module maintains a second table of throttle area compensation factors, applies a second upper limit to said throttle area compensation factors of said second table, determines a first relation between said throttle area compensation factors of said first table and said first upper limit, determines a second relation between said throttle area compensation factors of said second table and said second upper limit, and reports a maximum one of said first and second relations.

9. The control system of claim 8 wherein said diagnostic module selectively instructs said throttle control module to clear said first and second tables based upon user input.

10. The control system of claim 4 wherein said diagnostic module selectively instructs said throttle control module to clear said first table based upon user input.

11. The control system of claim 1 further comprising a visual display module, wherein said diagnostic module reports said coking value to said visual display module when said coking value exceeds a threshold.

12. The control system of claim 1 wherein said diagnostic module reports said coking value to a scan tool operated by said user.

13. The control system of claim 1 further comprising a remote diagnostic module, wherein said remote diagnostic module transmits said coking value to a service provider.

14. The control system of claim 13 wherein said service provider includes a satellite service provider.

15. A method comprising:

controlling a position of a throttle of a vehicle;

compensating for changes in effective opening area of said throttle due to coking; and reporting a coking value to a user based upon an amount of compensation performed.

16. The method of claim 15 further comprising determining said coking value based upon said amount of compensation performed with respect to an amount of compensation allowed.

17. The method of claim 16 further comprising determining said coking value by dividing said amount of compensation performed by said amount of compensation allowed.

18. The method of claim 15 further comprising maintaining a first table of throttle area compensation factors.

19. The method of claim 18 wherein said first table is indexed by uncompensated throttle area.

20. The method of claim 18 further comprising:

applying a first upper limit to said throttle area compensation factors; and reporting a relation between said throttle area compensation factors and said first upper limit.

21. The method of claim 20 further comprising reporting a percentage calculated by dividing a maximum one of said throttle area compensation factors by said first upper limit.

22. The method of claim 20 further comprising:

maintaining a second table of throttle area compensation factors;

applying a second upper limit to said throttle area compensation factors of said second table;

determining a first relation between said throttle area compensation factors of said first table and said first upper limit;

determining a second relation between said throttle area compensation factors of said second table and said second upper limit; and reporting a maximum one of said first and second relations.

23. The method of claim 22 further comprising selectively clearing said first and second tables based upon user input.

24. The method of claim 18 further comprising selectively clearing said first table based upon user input.

25. The method of claim 15 further comprising visually reporting said coking value to said user when said coking value exceeds a threshold.

26. The method of claim 15 further comprising reporting said coking value to a scan tool operated by said user.

27. The method of claim 15 further comprising transmitting said coking value to a service provider.

28. The method of claim 27 further comprising transmitting said coking value to a service provider via satellite.

* * * * *